United States Patent [19]

Rammos et al.

[11] Patent Number: 4,783,663

[45] Date of Patent: Nov. 8, 1988

[54] UNIT MODULES FOR A HIGH-FREQUENCY ANTENNA AND HIGH-FREQUENCY ANTENNA COMPRISING SUCH MODULES

[75] Inventors: Emmanuel Rammos, Creteil; Bernard M. Byzery, Paris, both of France

[73] Assignee: U.S. Philips Corporation, New York, N.Y.

[21] Appl. No.: 870,675

[22] Filed: Jun. 4, 1986

[30] Foreign Application Priority Data

Jun. 4, 1985 [FR] France ..... 85 08399

[51] Int. Cl.[4] ..... H01Q 3/26

[52] U.S. Cl. ..... 343/778; 343/786

[58] Field of Search ..... 343/776, 777, 778, 783, 343/772, 786

[56] References Cited

U.S. PATENT DOCUMENTS

| | | | |
|---|---|---|---|
| 2,973,487 | 2/1961 | Hanson et al. | 343/776 |
| 3,037,204 | 5/1962 | Allen et al. | 343/776 |
| 3,977,006 | 8/1976 | Miersch | 343/778 |
| 4,476,470 | 10/1984 | Bowman | 343/778 |
| 4,527,165 | 7/1985 | de Ronde | 343/778 |
| 4,614,947 | 9/1986 | Rammos | 343/778 |

FOREIGN PATENT DOCUMENTS

| | | | |
|---|---|---|---|
| 0294587 | 4/1966 | Australia | 343/783 |

*Primary Examiner*—William L. Sikes
*Assistant Examiner*—Doris J. Johnson
*Attorney, Agent, or Firm*—Robert J. Kraus

[57] ABSTRACT

In a high-frequency antenna comprising a plurality of horns 1, phase differences arising in these horns 1 would need to be corrected. Such phase differences are avoided by providing a planar design of the antenna comprising four adjacent horns 1 fed by T-shaped power divider 6, being linear and symmetrical.

9 Claims, 8 Drawing Sheets

UNIT MODULES FOR A HIGH-FREQUENCY ANTENNA AND HIGH-FREQUENCY ANTENNA COMPRISING SUCH MODULES

BACKGROUND OF THE INVENTION

The invention relates to a unit module for a high-frequency antenna for receiving or transmitting a rectilinearly polarized wave. The module has radiating elements in the form of horns and a power supply network assembled from waveguides of rectangular cross-section connected to the horns and also interconnected such that for each horn the total overall length of the supply path is the same.

The invention also relates to a high-frequency antenna comprising such unit modules.

The invention is used, for example, in making planar antennas for receiving television broadcasts transmitted via artificial satellites.

As antenna comprising radiating elements in the form of horns supplied by waveguides is disclosed in Patent Specification DE No. 2641711, which describes a linear antenna module, formed by a row of horns which are manufactured from one glass fibre block with metal-plated surfaces. This row of horns is fed by a main line and also by individual lines connected to the main line. The main line has a rectangular cross-section, is made from aluminium and may be filled with a dielectric material. This main line is realized such that in the plane of the electric field $\vec{E}$ it constitutes a multi-stage power divider by means of which it is possible to supply at equal powers the waveguides which provide the individual connection of the horns to the main line. Each of these waveguides, of rectangular cross-section, is constituted by a laminated structure having a dielectric material provided between two copper layers, the edges of this structure being metal-plated. The length of the individual supply waveguides and also the point in which they are connected to the main line are chosen such that for each horn the length of the supply path formed by the main line and the individual supply line will be the same. Such a structure has for its object to enable phase differences to be corrected in the power supply to these horns by reducing the length of certain individual power supply lines.

However, such an antenna has several disadvantages. First of all, it has of necessity very high losses since the propagation of the waves in a dielectric medium such as the medium constituted by the laminated structure of the individual power supply lines of the horn is always subjected to high losses, even if the dielectric material is of a very good quality. Using an identical dielectric material in the main line increases the losses still further. Added to that is the fact that the price of a high-grade dielectric material is always very high and considerably increases the cost of the antenna.

Moreover, the antenna module described in the document is of a linear shape, and is fed in series, because of which it is actually very difficult to obtain an accurate in-phase supply of the horns and it is therefore absolutely necessary to effect a length adjustment of the individual supply lines to improve this result. It remains, however difficult to obtain an accurate in-phase supply of all the horns when a wide operating frequency band is required.

In addition, the solution suggested by the document to solve this problem results in a very complicated shape of the antenna and also in assembly and adjusting procedures which are too critical to have them effected during, for example, large series production.

Moreover, to permit the use of this antenna in the reception of television transmission relayed via satellites, the antenna must have special properties.

It should be noted that such an antenna must be capable of receiving a right-hand of left-hand circular polarization, depending on the transmitting satellite.

It is a known fact that the polarization of an electromagnetic wave is defined by the direction of the electric field $\vec{E}$ in space. If in a point in space the electric field vector E remains parallel to a straight line, which is of necessity perpendicularly to the direction of propagation of the wave, this wave is polarized rectilinearly.

In contrast therewith, the wave is polarized circularly when the end of the electric field vector $\vec{E}$ describes a circle in the plane perpendicular to the direction of propagation. The polarization is a right-hand circular polarization when $\vec{E}$ rotates in the clockwise direction, seen in the direction of propagation. In the other case the polarization is a left-hand circular polarization.

A circularly polarized wave may be separated into two linearly polarized waves, which are perpendicular relative to each other and phase-shifted through $\pm\pi/2$.

The antenna designed for the intended use may consequently be realized in accordance with the following principle: the two perpendicular components, due to the transmission via the satellite of a circularly polarized wave, are pulled-in and thereafter composed with the appropriate phase-shift ($\pm\pi/2$ depending on the fact whether it is a right-hand or left-hand circularly polarized wave).

Putting this principle into effect assumes the use of a depolarizing radome before the antenna. This radome is designed such that it delays one of the components of the circularly polarized wave, thus producing the necessary phase-shift. The two linearly polarized waves are thus in-phase and the vectorial composition gives a linearly polarized wave which can be received by an antenna having one single linear polarization.

It should moreover be noted that for the intended use, the antenna must satisfy the standards formulated by the CCIR (Comité International de Radiocommunication). These conditions are as follows:

the frequency band must be between 11.7 and 12.5 GHz;

the radiation diagram of the antenna must vary in accordance with a profile according to which an attenuation of 3 dB of the main lobe corresponds to an aperture $\theta$ of the 2" microwave link, expressed by the relation:

$$\theta_{-3\,dB}=2''$$

which is the aperture of the microwave link at half-power, and according to which the secondary lobes are attenuated from 30 dB to 12";

the antenna gain G—to—noise temperature T ratio in degrees Kelvin must be:

$$G/T \geqq 6\ \text{dB.}^{\circ}\text{K.}^{-1}$$

Thus, for the indended use, it is important that:

the antenna must be easy to realize and at low cost so as to make the antenna available for the general public, the antenna must be of a reduced bulk and easy to mount, for example on a roof, so as to ensure that the cost of installation will not increase out of proportion compared with the price of the antenna, the technical qualities of the antenna must satisfy the standards put forward by the CCIR, and more specifically that the secondary lobes of the network are prevented from occurring.

For that reason the present invention provides a novel high-frequency antenna module which satisfies these conditions.

SUMMARY OF THE INVENTION

According to the present invention, these problems are solved by using an antenna unit module such as it is defined in the opening paragraph, characterized in that:

it comprises four adjacent horns whose square apertures form a bidimensional design in a plane parallel to a reference plane P, the waveguide supply network is of the "planar" type because it is distributed in one single plane parallel to the reference plane P, the largest dimension a of the waveguide section being in parallel with this plane P, the waveguide supply network is of the type commonly referred to as "tree-structured" because the horns are fed by means of T-shaped power dividers whose bars are rectilinear and symmetrical, at least one skirt of the guides, parallel to the dimension a, is provided with a fin in the symmetry plane.

In a further embodiment, this module is characterized in that at least one skirt of the apertures of the horns also has a fin.

The present invention has also for its object to provide a high-frequency antenna characterized in that it comprises a number of such unit modules which is a multiple of four, which are each fed by a tree-structured planar network of the same type as the network distributed within each module and in the same plane as the latter, so that all the horns of the antenna are fed by a signal which have the same amplitude and the same phase, respectively.

According to one embodiment, this antenna is characterized in that it is formed by two plates with electrically conductive surfaces, the horns being formed in the thickness direction of the first plate, the horn apertures terminating on the first face of this plate and the throats terminating on the second face, the waveguide supply network being formed by slots made in the first face of the second plate, these slots constituting three of the four faces of the waveguides and applying the second face of the first plate on the first face of the second plate forming the fourth face of the waveguides and the connections to the horns.

BRIEF DESCRIPTION OF THE DRAWING

According to a further embodiment, this antenna is characterized in that it is formed by two plates whose surfaces are electrically conducting, the horns being formed in the thickness direction of the first plate, the horn apertures terminating in the first face of this plate and the throats terminating in the second face, the waveguide supply network being formed by recessed slots made in this second face and constituting three of the four faces of the waveguides, the second plate having a first flat face and applying the second face of the first plate on the first face of the second plate forming the fourth face of the waveguides and the connections to the horns.

The antenna realized in accordance with the present invention has several advantages. First of all, it has the lowest possible losses because of the fact that it is entirely fed by the waveguides with the exclusion of any other type of dielectric except the air.

Thereafter, given the tree-structure of the supply network, all the horns are fed by signals having the same amplitude and the same phase, respectively, through a wide band of frequencies, without the necessity of making adjustments.

Furthermore, given the planar shape of the supply network, the antenna can be realized with the aid of two plates only, which may be metal plates or metal-plated plates, by a very simple manufacturing procedure. This manufacturing procedure is increasingly more simple according to whether the waveguide sections and the branches of the T-shaped power dividers are linear, the throats are at a right angle, and the designs formed by the horns are repetititive, as well as the design of the fins.

In addition, the antenna thus realized has excellent mechanical qualities. It is particularly robust, weather and age-resistant.

Finally, this antenna has high technical qualities. It can function in the high-frequency range, for example 12 GHz, and in a very wide frequency band.

Its directivity and its gain performances can even be adapted to receiving television transmissions via satellites. Actually, the presence of the fins in the waveguides and the horns make it possible to calculate for these waveguides and horns such dimensions that the network lobes are avoided.

Figure 1:
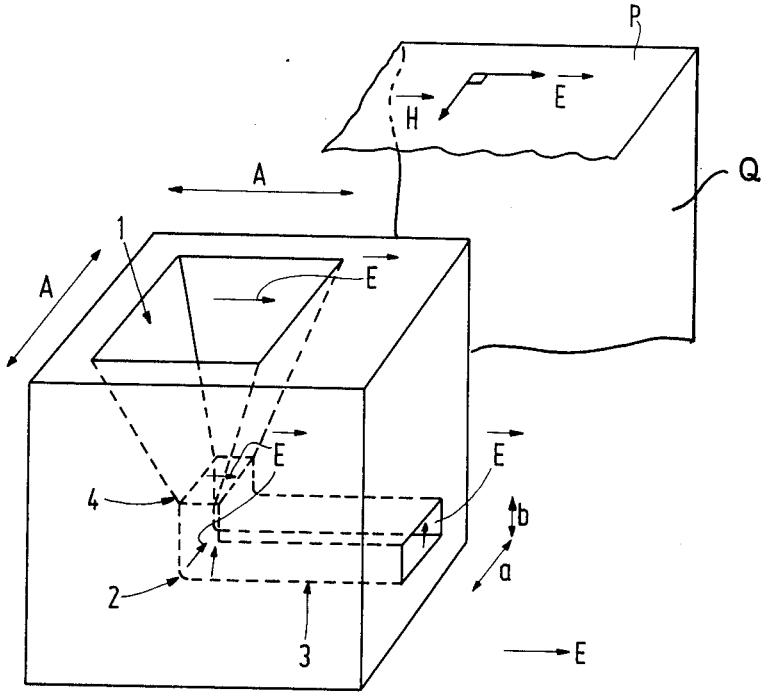
Figure 2A:
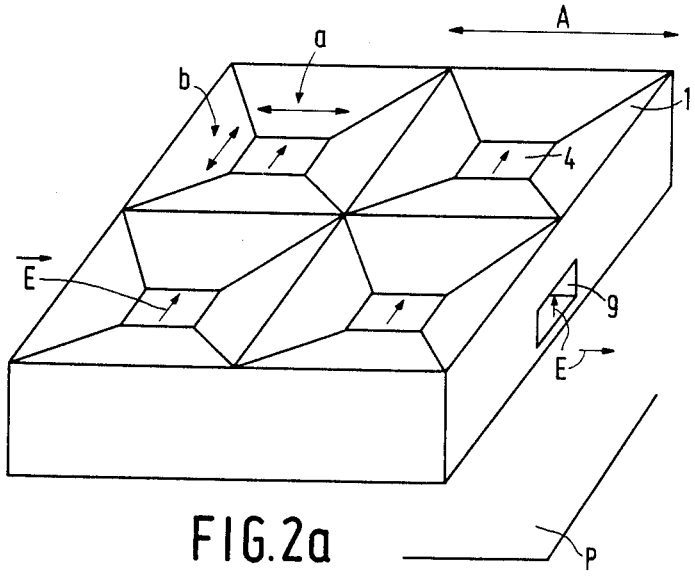
Figure 2B:
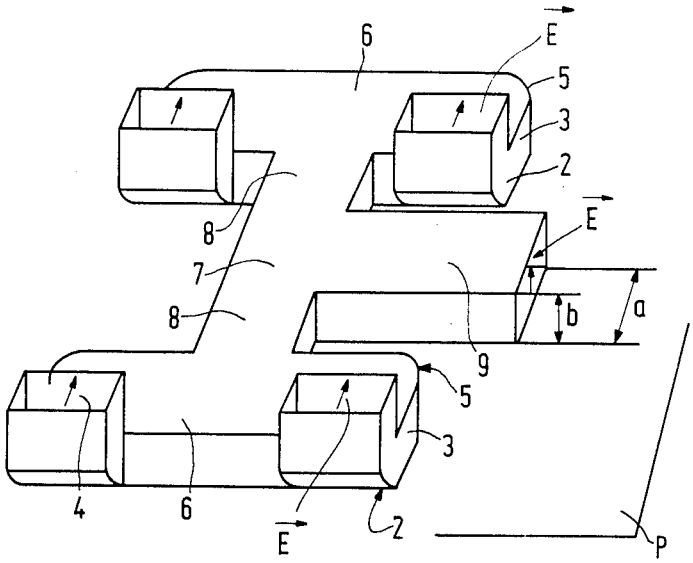
Figure 2C:
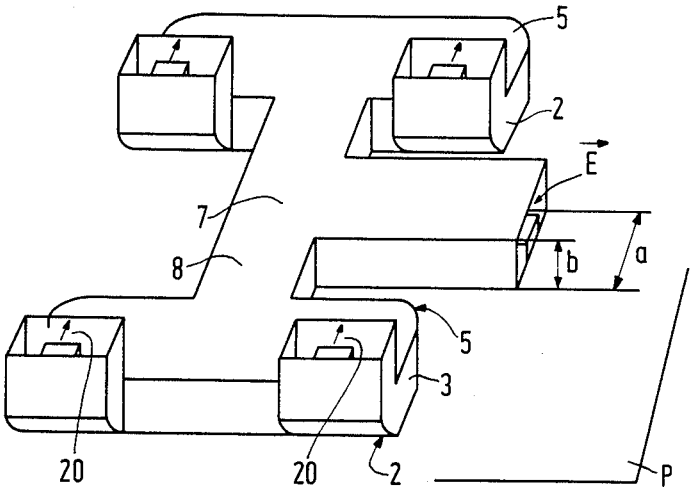
Figure 3:
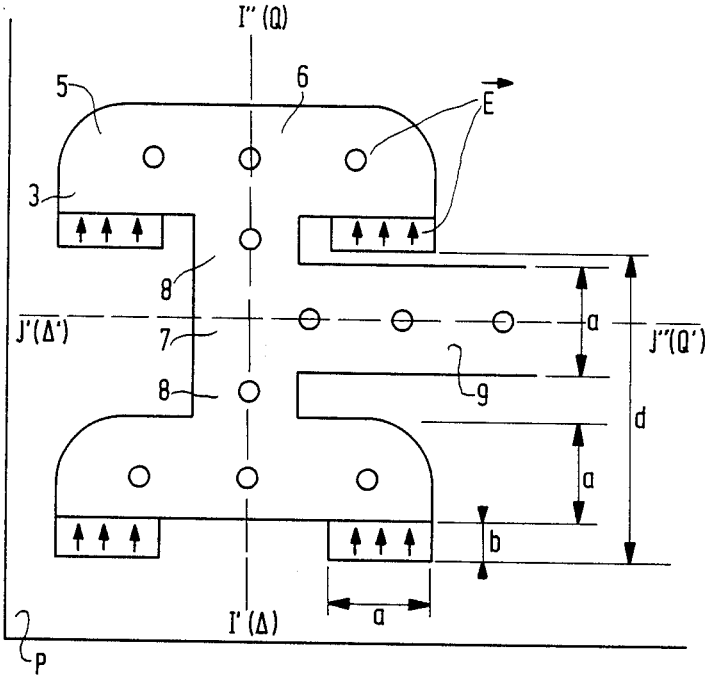
Figure 4A:
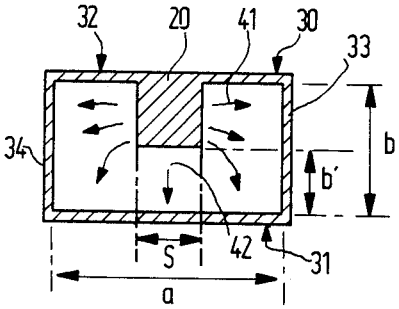
Figure 4C:
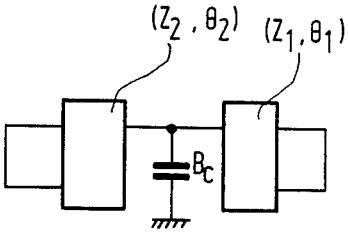
Figure 4B:
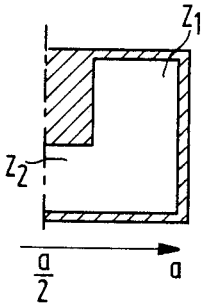
Figure 4D:
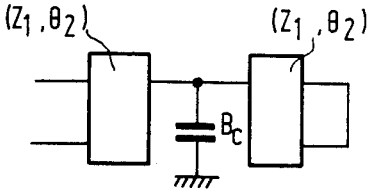
Figure 5A:
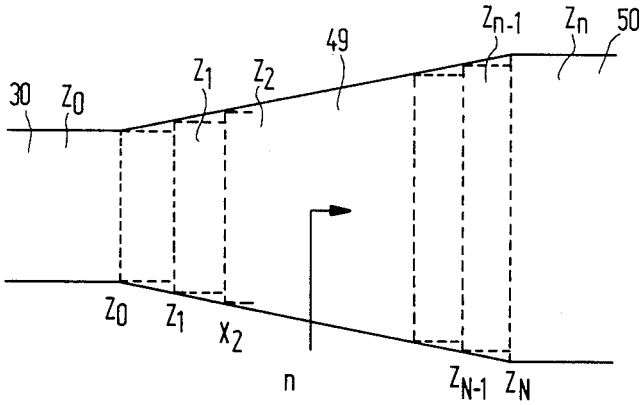
Figure 5B:
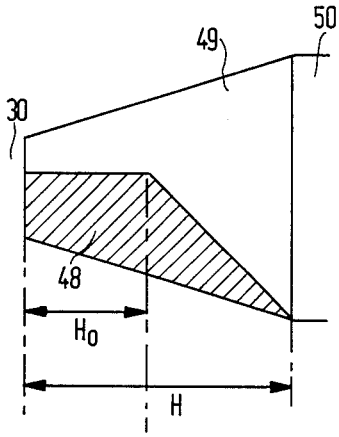
Figure 5C:
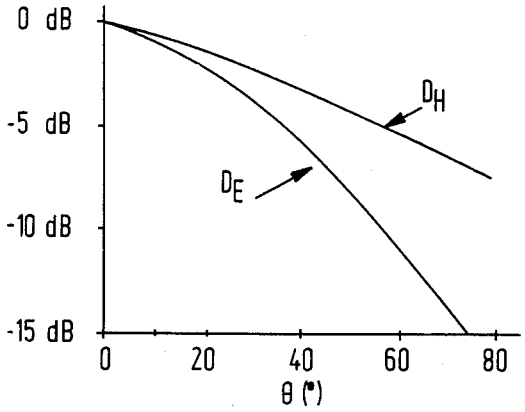
Figures 6A, 6C:
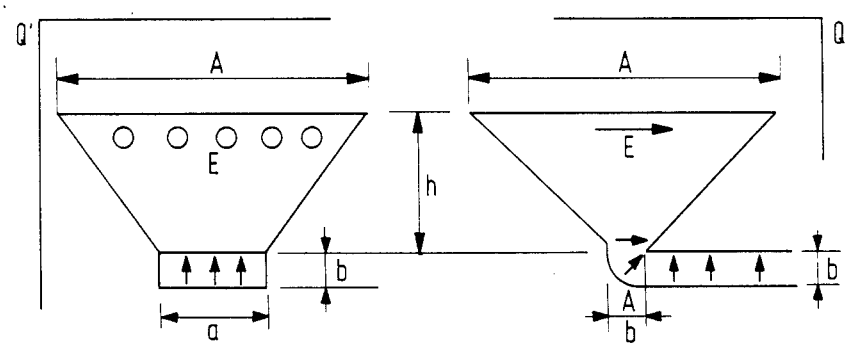
Figures 6B, 6D:
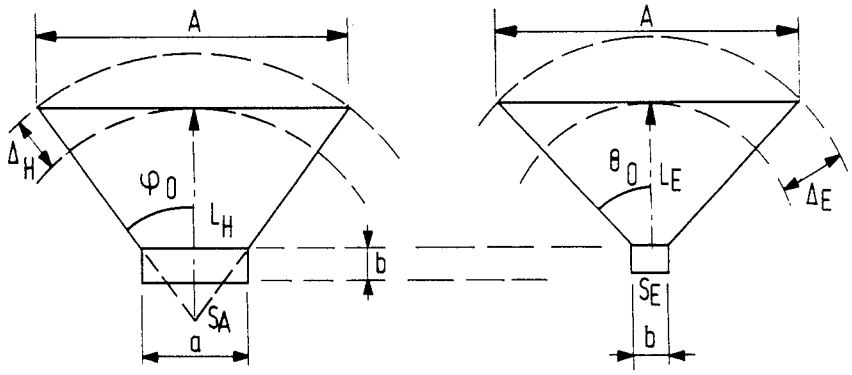
Figures 6E, 6F:
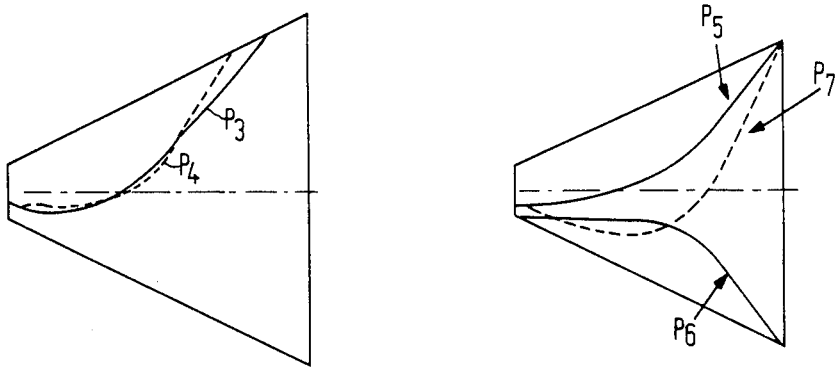
Figure 7A:
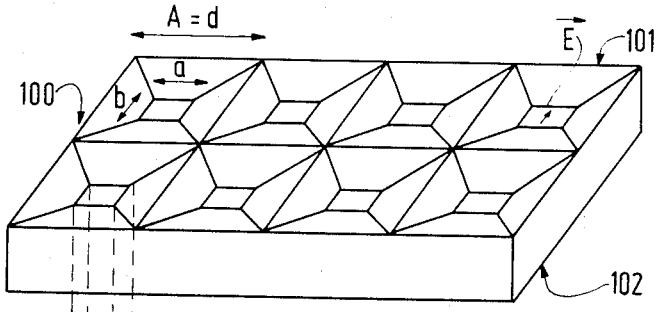
Figure 7B:
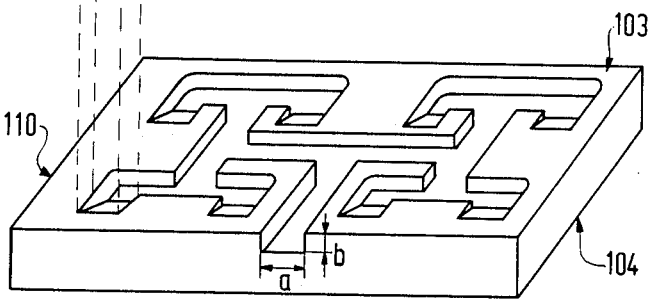
Figure 7C:
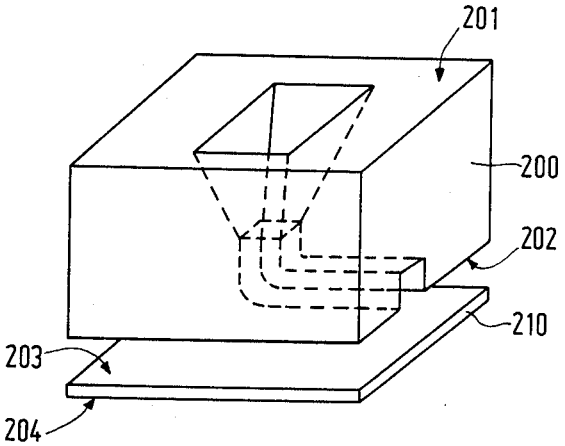
Figure 8:
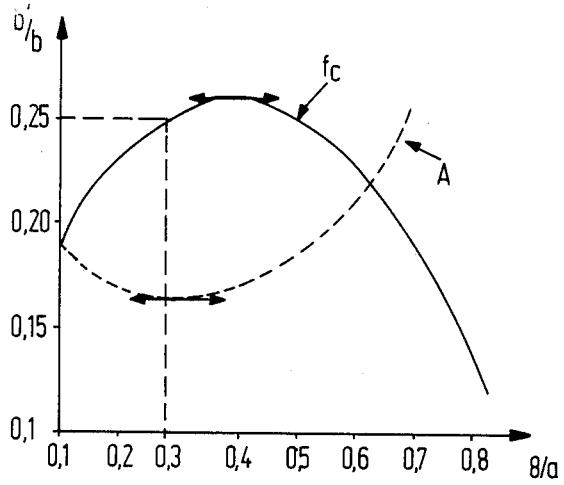
Figure 9:
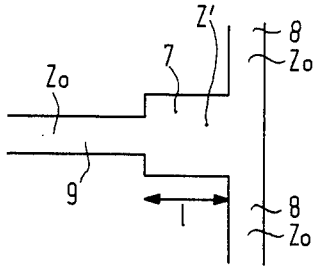
Figure 10A:
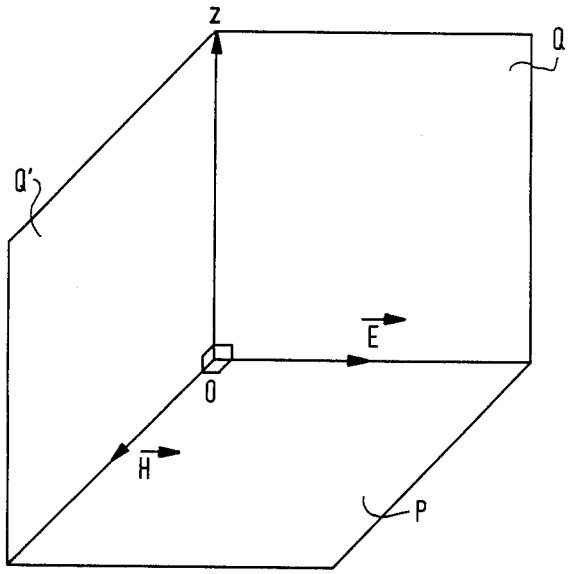
Figure 10B:
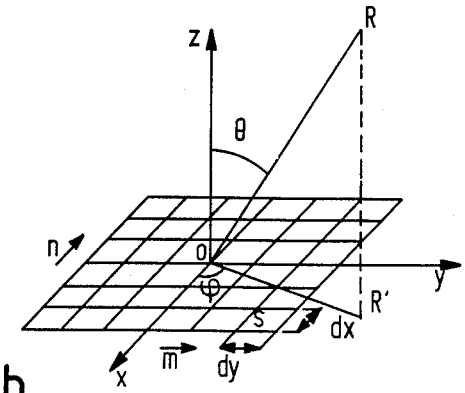
Figure 11A:
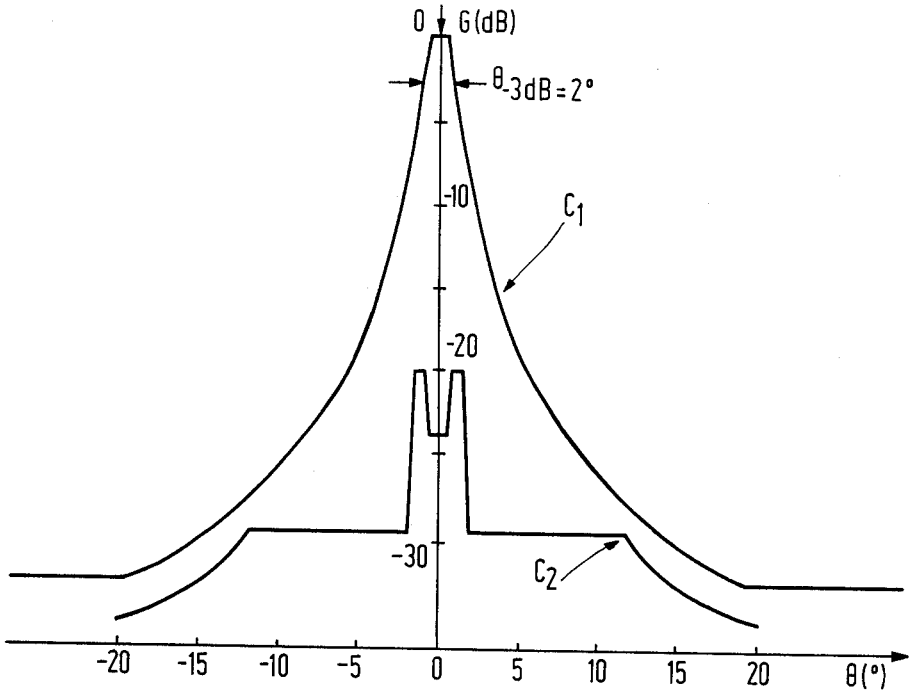
Figure 11B:
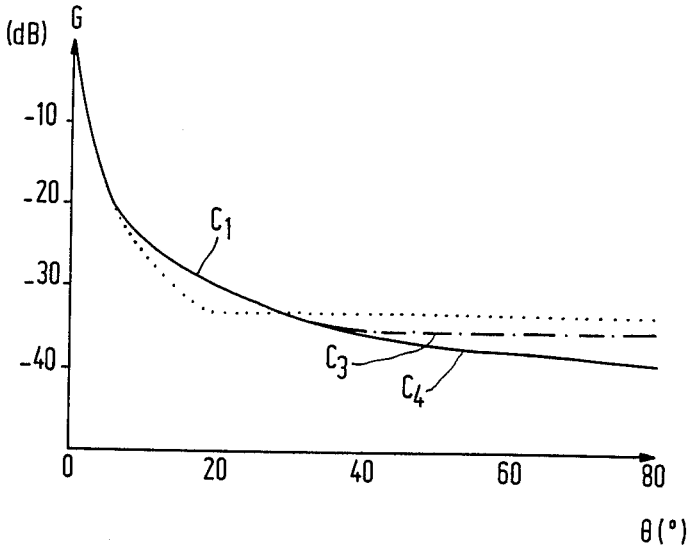

The invention and how it can be put into effect will be more apparent from the following description given by way of example with reference to the accompanying drawing figures, where:

FIG. 1 is a perspective view of a radiating element of a unit module according to the invention;

FIG. 2*a* is a perspective view of a unit module according to the invention;

FIG. 2*b* is a perspective view of the supply network of this module;

FIG. 2*c* shows the same supply network provided with fins;

FIG. 3 illustrates, in a sectional view parallel to the reference plane P, the supply network of this module, the respective axes I'I" and J'J" being the tracks of the symmetry planes of the network, which are in parallel with the planes A and Q', respectively;

FIG. 4*a* illustrates in a sectional view of a finned waveguide of the supply network;

FIG. 4*b* illustrates half of such a waveguide;

FIG. 4*c* illustrates the circuit which is equivalent to this half waveguide when n, the number of modes, is even;

FIG. 4*d* illustrates the circuit which is equivalent to this half waveguide when n is odd;

FIG. 5*a* illustrates a transition between two waveguides;

FIG. 5*b* illustrates such a transition provided with a stepped fin;

FIG. 5*c* shows the radiation diagram D of a rectangular aperture in the plane H and in the plane E;

FIGS. 6*a* and 6*c* shows rediating elements of the unit module, in a sectional view parallel to the plane Q' and a sectional view parallel to the plane Q, respectively;

FIGS. 6*b* and 6*d* show a plane sectorial horn $\overline{H}$ and a plane sectorial horn $\overline{E}$, respectively, which corresponds to the radiating element of the unit module;

FIG. 6*e* is a sectional view of a pyramidal finned horn having the fin being of an optimized shape;

FIG. 6*f* is a sectional view of a pyramidal horn having a pseudo-double fin;

FIGS. 7*a* and 7*b* show portions of the two plates constituting an antenna according to the invention, in one practical embodiment;

FIG. 7*c* shows a radiating element of the antenna in a different practical embodiment;

FIG. 8 shows the variation in the ratio s/a as a function of the ratio b'/b for a cut-off frequency of 10 GHz;

FIG. 9 is an example of how the power dividers are matched;

FIGS. 10*a* and 10*b* show the angular coordinates of a spatial point R relative to the reference plane P;

FIG. 11*a* shows the envelope $C_1$ of the radiating diagram of the antenna imposed by the CCIR standards when the antenna is used for the reception of television transmission via satellite and the envelope $C_2$ of the cross-polarization diagram and;

FIG. 11*b* shows, relative to this envelope $C_1$, the envelope of the theoretical radiating diagrams obtained with the aid of an antenna having one single fin ($C_3$) and an antenna having a pseudo-double fin ($C_4$).

DESCRIPTION OF THE PREFERRED EMBODIMENTS

As is shown in a perspective view in FIG. 1, the radiating element of a unit module of the antenna according to the invention, is constituted by a horn 1 whose aperture has a square section with side A. During operation of the antenna, to enable the reception or transmission of a linearly polarized wave, the aperture of the horn is placed in parallel with a reference plane P defined by the direction of propagation of the electric field $\vec{E}$ and the magnetic field $\vec{H}$ in the environment exterior to the antenna, and the sides of the square aperture of the horn are each positioned either in parallel with the electric field $\vec{E}$ or in parallel with the magnetic field $\vec{H}$ of the environment exterior to the antenna.

The throat 4 of the horn 1 is connected to the waveguide 3 via an elbow 2. The waveguide 3 and the internal throat 4 have a rectangular cross-section with sides a and b such that $a \geq b$.

The electric field $\vec{E}$ propagates in parallel with side b and the magnetic field $\vec{H}$ propagates in parallel with side a.

The waveguide 3 is positioned such that the dimension a of its section is in parallel with the reference plane P and the dimension b is perpendiculr to the reference plane P. In these circumstances, the electric field $\vec{E}$ propagates in the waveguide 3 perpendicularly to the reference plane P, and the magnetic field $\vec{H}$ propagates in parallel with the reference plane P. The waveguide 3 is called "plane $\vec{H}$".

The angle of the elbow 2 connecting the throat 4 to the waveguide 3 is consequently positioned in a plane parallel to a plane Q, the plane Q being defined as being perpendicular to the plane P and in parallel with one of the sides of the horn apertures. During operation, in the elbow 2, this plane is in parallel with the vector $\vec{E}$. The elbow 2 may be called "elbow plane $\vec{E}$". In the environment exterior to the antenna, the plane Q is defined, during operation, by the magnetic field $\vec{E}$ and the perpendicular line oz relative to the plane P, as is shown in FIG. 10*a*.

The antenna module according to the invention is formed by four horns whose apertures form a design which is repeated by simple translation, in accordance with the two axes parallel to the sides, with the same step size, in a plane parallel to the reference plane P, as is shown in FIG. 2*a* in a perspective plan view.

The supply network of these four horns is shown in a perspective view in FIG. 2*b*. This network is a "planar" network because it is distributed in a single plane parallel to the reference plane P. All the waveguides interconnecting the individual supply guides 3 of the horns are of the same type as the guides 3, that is to say they are "plane $\vec{H}$".

The planar supply network is consequently said to be of the "plane $\vec{H}$" type.

Moreover, to enable the supply of the four horns with the aid of the signals having the same phase and the same amplitudes, respectively, this network is of the "tree-structure" type. Actually, the horns are fed pairwise in a symmetrical manner relative to a plane parallel to plane Q, for forming two groups of identical radiating elements. Thereafter, the two groups thus formed are symmetrically fed, relative to a plane parallel to a plane Q', this plane Q' being defined as being perpendicular to both the reference plane P and the plane Q, as is shown in FIG. 10*a*. In the environment externally of the operative antenna, the plane Q' is defined by the magnetic field $\vec{H}$ and the perpendicular oz relative to the plane P.

As is shown in a perspective view in FIG. 2*b* and in a cross-sectional view parallel to plane P in FIG. 3, the supply symmetry of the two horns can be obtained by means of a planar network such that the elbows 5, whose angle is located in the plane of the network connects the individual supply guides 3 of these horns to a T-shaped power divider 6 in the same plane. The symmetry plane of the system formed by the two horns, the two elbows 2, the two individual guides 3, the two elbows 5 and the power divider 6, is a plane parallel to Q whose path is denoted by I'II" in FIG. 3.

The supply symmetry thus formed for the two groups of two horns each is obtained by connecting the waveguides 8 coming from the power divider 6 via a T-shaped power divider 7 located in the plane of the network. The power divider 7, which has an output 9, and the waveguide sections 8 define as the symmetry plane a plane parallel to Q' whose path is denoted by J'J" in FIG. 3.

Thus, for each horn, the length of the feed path is exactly the same and the horns are fed perfectly in-phase. Moreover, all the waveguide sections are rectilinear and located in a plane parallel to that of the horn apertures.

A high-frequency antenna can be assembled from a multiple of four of such unit modules fed by a tree-structured planar network of the same type as the network distributed within each module and in the same plane as the latter. Thus, the antenna may comprise a sufficient number of radiating elements to obtain the desired gain for the antenna and all the radiating elements of the antenna are still fed by signals having the same amplitudes and the same phases, respectively, which makes it possible to obtain a maximum radiation perpendicularly to the plane P and consequently a maximum gain in conformity with the recommendations of the CCIR.

The following example is given to demonstrate that the antenna according to the invention may have technical characteristics which are appropriate characteristics for receiving television transmission via artificial satellites.

EMBODIMENT

I. Conditions to prevent lobes of the network

It should be noted that for an assembly of (M×N) sources which are separated from each other by a distance defined by the parameters dx and dy such as shown in FIG. 10*b*, and assuming that A(m, n) and $\phi$(m, n) are the amplitude and the phase of the source indicated by (m, n), the contribution of all these sources to point R will be:

$$E_p = \sum_{m=1}^{M} \cdot \sum_{n=1}^{N} \cdot A(m,n) \cdot$$

$$\exp j\{k \cdot dy \cdot m' \cdot \sin\theta \cdot \cos\phi + kdx \cdot n' \cdot \sin\theta \cdot \sin\phi + \phi(m,n)\}$$

$$\text{where} \begin{cases} m' = m - 1 \\ n' = n - 1 \\ k = 2\pi/\lambda_o \text{ (wave vector)} \end{cases}$$

For the simple case in which all the sources have the same amplitudes (A(m, n)=$A_0$) and the same phases ($\phi$(m, n)=$\phi_0$), it can then be demonstrated that the contribution to point P can finally be written as:

$$E_p = A_o \exp j\phi_o (\sin Mu/\sin u)(\sin N\theta/\sin\theta)$$

where $u = \pi.(dy/\partial)\cdot\sin\theta\cdot\cos\phi$ $v = \pi\cdot(dx/\partial)\cdot\sin\theta\cdot\sin\phi$ The network factor is defined by:

$$F_{network} = E_p \cdot E_p^* / (E_p \cdot E_p^*)_{max}$$

and finally can be written:

$$F_{network} = [\sin Mu/M \sin u^2]\cdot[\sin N\theta/N \sin\theta]^2$$

In the plane (yoz), where $\phi$=0, the maximum of the network factor is obtained by verifying that:

$$M \sin U = \sin M u = 0$$

that is to say $$\boxed{\theta_{max} = \arcsin[p \cdot \lambda/dy]} \quad (p\text{:integer} > 0)$$

Thus, this relation provides the condition to be fulfilled by the assembly of the (N×M) sources so as to avoid the occurrence of network lobes (lobes having amplitudes equal to those of the main lobe): It is sufficient to have dy such as:

$$dy < \lambda \text{ i.e. } dy/\lambda < 1$$

According to the present invention, it was opted for to assemble the antenna by positioning the radiating elements with a step size d.

It is then necessary that:

$$d < \lambda \text{ wherein } d/\lambda < 1$$

This relation provides that in order to completely avoid the network lobes it is necessary that the spacing d between the radiating elements must be less than the wavelength propagated in the waveguide. In the opposite case, network lobes will appear. But they are closer to or farther away from the main lobe depending on the value of the ratio $\lambda$/d.

According to the present invention, it will be obvious from FIG. 3 that this relation can only be verified when the dimension a of the waveguides is not too large. The solution of this problem is therefore to provide the skirts of the waveguides parallel to a with a fin. The waveguides thus formed are of a small bulk compared to a rectangular waveguide without a fin of the same cut-out frequency.

The supply network formed by finned waveguides is shown in a perspective view in FIG. 2*c*.

II. Conditions for receiving the transmissions via satellite

As the antennas are mainly intended for use by the general public, the conditions on which its design is based will be the recommendations by the C.C.I.R. as regards the frequency band: 11.7 GHz to 12.5 GHz the gain G≈33 dB the aperture $\theta_{-3\,dB} \leqq 2''$.

The profile to be satisfied is shown in FIG. 11*a*. The curve $C_1$ is the envelope of the radiating diagram and the curve $C_2$ is the envelope of the cross-polarization diagram.

In addition to the fact that the antenna must be cheap to manufacture, its efficiency must be high: for that purpose it is necessary to optimize the radiation element and to minimize the losses in the circuit.

III. Determining the cut-off frequency of a finned waveguide

FIG. 4*a* shows a transversal cross-sectional view of a waveguide 30 provided with a fin 20, placed on the skirt 32 having the dimension a. The fin 20 has a depth s and leaves an aperture of the dimension b' between its end and the skirt 31 opposite to the skirt 32.

At the cut-off frequency $f_c$, the electromagnetic field may be considered to be the resultant of the wave travelling from one edge of the waveguide to the other at the wavelength $\lambda_c$.

On cut-off, this problem can therefore be treated in analogy to two parallel transmission lines of infinite short-circuited width in two points.

Cutting-of in accordance with the $TE_{10}$ mode will then appear at the frequency for which the transmission line has its lowest resonance (for the $TE_{no}$ the cut-off frequency of the $n^{th}$ mode will appear at the resonance of the order n). When the order n is odd (see FIG. 4*d*), the resonance must be of the type giving an infinite impedance in the centre (at a/2): for n is even (see FIG. 4*c*) this impledance must be zero.

At the cut-off frequency the FIGS. 4*c* and 4*d* are the equivalent circuit diagrams of the Figure in which the susceptance $b_c$ represents the discontinuity due to the height variation (at s/2); this capacitance value, which is a function of the fin height, can be calculated on the basis of the below Marcuvitz formulae (1) and actually represents the effect of the higher modes.

FIG. 4*c* shows the equivalent circuit diagram of FIG. 4*b* for n is even, and FIG. 4*d* for n is odd.

$z_1$ represents the impedance in the cavity 41 and $z_2$ represents the impedance in the cavity 42, $\theta_1$ and $\theta_2$ are the associated electric lengths:

$$\theta_1 = (\pi/\lambda_c)\,(a-s)$$

$\theta_2=(\pi/\lambda_c)s$

Based on the theory of passive lines without losses and assuming that the impedance of the lines is proportional to their height, it is then possible to define the dispersion equations which enable the calculation of the cut-off frequencies of the $TE_{no}$ modes of the finned guides. For n is odd:

$$\mathrm{cotg}[\pi(1 - s/a)/(\lambda_c/a)] - (b/b')tg[(\pi s/a)/(\lambda_c/a)] - B_c/\phi_1 = 0 \quad (1)$$

For $n$ is even:

$$\mathrm{cotg}[\pi(d - s/a)/(\lambda_c/a)] + (b/b')tg[(\pi s/a)/(d_c/a)] - B_c/\phi_1 = 0$$

Solving the equations (1) can be effected by means of an iterative method.

After having solved these equations, a slight shift can be detected between the curves given by Hopfer in IRE Transactions MTT (October 1955) and the results obtained. This can be explained by the fact that the Marcuvitz formulation in "Waveguide Handbook" Mac Graw Hill, Book Company (1951), for the capacitive term, does not take the proximity of the lateral metal skirts into account.

Whinnery and Jamieson in "Equivalent circuits for discontinuities in transmission lines" IRE 98 (February 1944) have determined the value of this capacitance by taking the proximity effects of the metal skirts into account. For our case a good approximation of the corrective factor is obtained by the function:

Cotgh (a−s)/2b

Taking account of this correction, the results obtained are then in proper agreement with the Hopfer curves. These curves show that the largest bandwidth is obtained with a lowest possible ratio b'/b.

For a study of the transition between two waveguides, where it is important, or even necessary, to know the value of the cut-off frequency in each point of the transition, the relations (1) are almost unfit for use as they require very long computation times. An approximated analytical expression is then preferred, which is easier to use.

IV. Analytic formulation of the cut-off frequency

When evaluating the capacitance effect introduced by the presence of the fin in the waveguide (proportionality between the surfaces), and empirically determining the correction terms, Hoefer and Burton ("Closed-form expressions for the parameters of finned and ridged waveguides" IEEE MTT, December 1983) which ultimately result in the following analytic expression:

$$b/\lambda_{c10} = [b/2(a - s)\{1 + (4/\pi)(1 + 0{,}2\sqrt{(2b/(a - s)} \cdot 2b(a - s) \cdot \mathrm{Ln}[\mathrm{cosec}(\pi b'/2b)] + (2{,}45 + 0{,}2\, s/a)[sb/b'(a - s)]\}^{-1} \quad (2)$$

(in the case of dual finned waveguides, the term (2b) must be replaced by (b)). Where $\lambda_{c10}$ is the cut-off wavelength in the $TE_{10}$ mode.

This formulation is in appropriate agreement with the numerical methods for the following variations of the parameters (b/a, s/a, b'/b)

$$\begin{cases} 0.01 \leqq b'/b \leqq 1 \\ 0 \leqq b/a \leqq 1 \\ 0 \leqq s/a \leqq 0.45 \end{cases}$$

It will be obvious that the relation (2) can easily be used by any calculator and could then be used for the case in which the dimensions of the different elements change continuously (transitions, adaptation, . . . ).

V. Impedance characteristic

For lines it is possible to define unambiguously an impedance characteristic $Z_c=[V(z)/I(z)]$.

This is no longer holds for the waveguides, actually the functions $\psi_E$ (or $\psi_H$), which fulfil the propagation equation $[(\Delta^2+k^2)\ \psi_{E,H}=0]$, do not satisfy the Laplace equation $[\Delta V=0]$. On the other hand, a longitudinal electromagnetic component always exists in waveguides, this component being directly linked to the corresponding generating function.

In spite of all this, with the object of introducing a magnitude which facilitates the calculations, three types of impedances have been defined:

$$\text{voltage - current } Z_{v,i} = v/i \quad (3)$$

$$\text{voltage - power } Z_{v,p} = v \cdot v^*/2p$$

$$\text{power - current } Z_{p,i} = 2 \cdot p/ii^*$$

These different impedances are defined by the following relation:

$$Z_{v\,i} = \sqrt{Z_{p\,i} \cdot Z_{p\,v}} \quad (4)$$

In the literature, more specifically in the publications by Mihran ("closed and open-ridge waveguide" IRE, 37,640, 1949), the analytic expressions of the impedances Zpv and Zvi are found at an infinite frequency which is a function of the capacitance equivalent to the discontinuity because of the fin.

By eliminating this capacitance with the aid of the relation (1), the following relations (5) are obtained:

$$\left.\begin{aligned} Z_{v,i} &= 120\pi \cdot (\pi b/\lambda_{c10})\sin\theta_1 \cdot \sin\theta_2 \\ Z_{f,v} &= 120\pi\{(\lambda_{c10}/4b)[2\theta_2 - \sin(2\theta_2) + (b/b') \cdot \\ &\quad (\cos\theta_2/\sin\theta_1)^2(2\theta_1 + \sin 2\theta_1)]\}^{-1} \end{aligned}\right\} \quad (5)$$

knowing the impedance at an infinite frequency, it is then easy to calculate it at any frequency.

VI. Attenuation in a finned waveguide

In a conventional rectangular waveguide, it can be demonstrated that, as a function of its dimensions (a, b), the attenuation A of the conductivity of the material used ($\tau$), is given by the following relation:

$$A = \pi\mu_m\, \epsilon/6\mu \cdot \sqrt{f}\ [(1/a) + (2/b)(f_c/f)^2][1 - (f_c/f)^2]^{-\frac{1}{2}}$$

expressed in Np/m, wherein, being the speed of light, f and $f_c$ represent the operating frequency and the cut-off frequency ($f_{c10}=c/2a$), respectively.

For a waveguide filled with air, it holds that:

$$\begin{cases} \mu m = \mu o = 4\pi \cdot 10^{-7}\ H/m \\ \epsilon = \epsilon_o = 8.854 \cdot 10^{-12} \end{cases}$$

and when copper is used as the material ($\tau = 58{,}1\ 10^6$ ohm.cm), the relation (6) is obtained. The attenuation is then expressed by:

$$A = 6{,}01 \cdot 10^{-7} \sqrt{f}\ [(1/a) + (2/b)(f_c/f)^2][1 - (f_c/f)^2]^{-\frac{1}{2}} \quad (6)$$

expressed in dB/m, where a and b are expressed in cm.

However, according to Cohn ("Properties of ridge waveguide, IRE, 1947), the attenuation is given by the relation:

$$A = 6{,}01 \cdot 10^{-7} \cdot \sqrt{f} \cdot [(1/a) + (2/b)\,(f_c/f)^2]\,[1 - (f_c/f)^2]^{-\frac{1}{2}} \cdot k \cdot [60\pi^2(b/a)]/(Z_{v,i})\infty] \quad (7)$$

where K is a correction factor which is estimated by Cohn to be slightly higher than 1.

If reference is made to relation (5), which gives the voltage-current impedance $(Z_{vi})_x$, it is easy to demonstrate that the relation (7) is actually nothing else but the attenuation formula of the conventional rectangular waveguide weighted by a proportionality factor.

VII. Hopfer formula

This relation must be compared with the relation offered by Hopfer (reference cited in the foregoing), which gives for the attenuation:

$$A = 8{,}686[(\pi\lambda_c/b\lambda^2) + Q][(\lambda_c/\lambda)^2 - 1]^{-\frac{1}{2}} \cdot \rho(\text{dB/m}) \quad (8)$$

where:

$$Q = \{\{[2\pi(\alpha - \beta)/\beta^2]p^2[tg(\pi\gamma/k) + (\pi\gamma/k)\sec^2(\pi\gamma/k)] + (4\pi^2/k)B^{12}\,(\alpha - \beta)/\alpha\}tg^2(2\pi\delta/k) + (4\pi^2/k)\sec^2(2\pi\delta/k)\} \cdot \{ka^2\{(2\alpha/\beta)[tg(\pi\gamma/k) + (\pi\gamma/k)\sec^2(\pi\gamma/k)]tg^2(2\pi\delta/k) - 2tg(2\pi\delta/k) + (4\pi\delta/k)\sec^2(2\pi\delta/k)\}^{-1}$$

$$\alpha = b/a,\ \gamma = s/a,\ \beta = b'/a$$

$$\delta = (1 - s/a)/2,\ k = \lambda_c/a\ \rho = \lambda_c/\lambda$$

and $\rho$ is the thickness of the skin (in meters) of the material used.

It will be obvious that the two theoretic formulations (7) and (8) result in curves (not shown here) which slightly deviate, this deviation increases versus the ratio $f/f_c$.

It will also be noted that the increase in the bandwidth when the finned waveguide is used occurs at the cost of an increase in the losses.

VIII. Evaluating the fields in a finned waveguide

It might be interesting to know the value of the electro-magnetic fields in any point of the structure; more specifically to enable the calculation of the power transported in the waveguide or rather, for example, to search for the magnetic circular polarization positions (Hz, Hx) for use as resonant insulators.

With the aid of the methods described in the foregoing, it is not possible to have access at any moment to the components of the electromagnetic field. It is then necessary to use other techniques: for example, to use the modal development technique used by Collins and Daly ("orthogonal mode theory of single ridge waveguide", J. Electronics Control (63), 17, 121, (1964)) or the technique of finite differences used by Young and Hohman ("Characteristics of ridge waveguides" Applied Science Research Section B, 8, 321 (1960)). The mathematical development of these methods require heavy data processing means, but allow access to all the electromagnetic magnitudes.

The general shape of the lines of the electric fields is shown in FIG. 4*a*.

IX. Determining the dimensions of the finned waveguide

This swift preliminary theoretical study makes it possible for a person skilled in the art to better understand how the antenna according to the invention is realized.

The fins are positioned in the waveguide supply circuit as shown in FIG. 2*c*.

To satisfy the condition $d < \lambda_o$ where $$d/\lambda_o \simeq 0.9$$

a minimum spacing, for 12.1 GHz might be chosen $$d = 22.5\ \text{mm}$$

As is shown in FIG. 3, the dimensions a and b are associated with the inter-component distance. Taking account of the thicknesses $\delta$ and $\delta'$ necessary for the mechanical realization (machining, moulding) of the order of 3 mm in total, it is demonstrated that in the present case the width a is given by:

$$a = 19.5/[2 + b/a]\text{(in mm)} \quad (9)$$

By fixing the ratio (b/a) the value of a is then known. With the aid of the relation (2) the pair of values (s/a—b'/b) are determined such that the desired cut-off frequency is obtained (for example 10 GHz). For each of these pairs the theoretical attenuation is then calculated which would be obtained at a frequency equal to, for example, 12.1 GHz, using the relation (8). Then the ratios b'/b and s/a which result in a minimum attenuation are chosen.

FIG. 8 shows an example of the results. The Figure shows that for a ratio (b/a) equal to 0.45 and a cut-off frequency of 10 GHz the dimensions of the fin are:

$$b' = 0.9\ \text{mm}$$

$$s = 2.2\ \text{mm.}$$

It will however be obvious that in this curve (FIG. 8) the values calculated by the ratios $s/a \geqq 0.45$ are incorrect because of the limitation of the Hoefer and Burton formulae.

X. A study of the transition between the finned waveguide and a rectangular guide It is also important to study the transition between the finned waveguide and a rectangular guide operating in the Ku band.

By imposing a linear variation of the waveguide sides, a fin shape must be found such that, by its dimensions, it realizes a cut-off frequency below the desired frequency band and a proper adaptation.

To solve this problem, one can simulate the transition by an infinite number of discontinuities which are separated from each other by a distance $\Delta_x$. This simulation is illustrated in FIG. 5*a*.

The coefficient of global reflection will then, in a first approximation, be the sum of all the reflections seen in each discontinuity, weighted by the appropriate phase shift, that is to say:

$$\Gamma = \Gamma_1 \cdot \exp[-2\gamma_o\Delta x] + \Gamma_2 \cdot \exp[-2\gamma_o\Delta x - 2\gamma_1\Delta x] + \ldots$$

$$\Gamma_N \cdot \exp\left[-2 \cdot \sum_{m=o}^{N-1} \gamma_m \Delta x\right]$$

wherein $\gamma_m$ is the propagation constant in the section under consideration, this relation can then be simplified to the following form:

$$\Gamma \sim \sum_{n=1}^{N} / \cdot \Gamma_n \cdot \exp\left[-2 \cdot \sum_{m=o}^{n-1} \gamma_m \Delta x\right] \quad (10)$$

where:

$$\Gamma_n = [Z_n - Z_{n-1}]\,[Z_n + Z_{n+1}]^{-1}$$

$$\gamma_m = i(2\pi/\lambda_{gm}) = i(2\pi/\lambda)\sqrt{1 - (\lambda/\lambda_{cm})^2}$$

(Formula 10) is obtained by taking into consideration very small height discontinuities compared with the wavelength and disregarding the influence of higher order modes.

It will here be evident that the formulation by Hoefer and Burton (relation 2) is very important as regards the determination of the cut-off frequency of the fundamental mode $TE_{10}$. Using a very fast calculation, it is then possible to determine in each point of the transition the length of the cut-off wave (relation 2), the characteristic impedance (relation 5) and thus to theoretically evaluate the desired adaptation by the relation (10).

This formula remains a very general formula and can be simply applied to the calculations of the transition between two rectangular waveguides by imposing in the calculation (s=0) and (b'=b).

The values calculated with the aid of the relation (10) are fully in agreement with the values given by MATSUMARU (Reflexion coefficient of E-plane tapered waveguides, IRE MTT, 6, 143 (1958)).

A transition 49 between a finned waveguide 30 and a waveguide 50 is shown in FIG. 5*b*. In the embodiment described here, the length of the transition 49, is, for example:

H=75 mm, which exceeds the guided wavelength. The length of the step 48 formed by the fin 20 is obtained from solving the equation (10) and depends on the choice of H.

XI. Study of the power dividers

If a symmetrical power divider is desired, the problem is to pass a certain impedance $Z_o$ in the main branch of the two divider branches of the same impedances. It is then necessary to use a quarter wave adapter having an impedance Z'; this results in the configuration shown in FIG. 9.

When $\rho$ is equal to a quarter wavelength, it is easy to demonstrate that the impedance Z' must be defined by the following relation (11):

$$Z' = Z_o/\sqrt{2} \quad (11)$$

To have the impedance of the finned waveguide vary, it is possible to vary either the width of the fin, or its height or the dimensions of the waveguide.

By incrementing the parameter opted for, the cut-off frequency and the impedance value are then calculated until the relation (11) is verified. It is then easy to determine the length of the quarter wave transition ($\rho=\lambda g/4$). ($\lambda_g$=wavelength in the waveguide).

For the dimensions shown in FIG. 8, it is not possible to verify the relation (11) by having the fin width vary. It is however possible, by varying the fin height, or the width of the waveguide, to obtain the theoretical adaptation.

$$\begin{cases} b'(\lambda g/4) = 0.71 \text{ mm} & \rho(\lambda g/4) = 9.53 \text{ mm} \\ a(\lambda g/4) = 10.52 \text{ mm} & \rho(\lambda g/4) = 8.44 \text{ mm} \end{cases} \quad (12)$$

For a mechanical realization the first solution is chosen: changing the height of the fin for the quarter wave transition.

XII. A study of the elbows plane E and plane H

It is very difficult to do a theoretical study of these elbows as couplings with the higher modes must be taken account of, which couplings are produced by the multiple reflections in the elbow.

The problems of these elbows in the conventional waveguides are frequently described in literature. In addition, assuming that the "finned" elbows behave in the same way as the conventional elbow, it may be assumed, considering the disclosures by Hsu Jui-Pong and Tetsuo Anada ("Planar circuit equation and its practical application to planar type transmission line circuit" IEEE MTT-s. Digest, 574 (1983)) that they do not of necessity result in significant mismatches.

It should be noted that, in view of the lines of the electric fields (FIG. 4*a*) the behaviour of these elbows must be slightly different. In spite of all this, the perturbation produced must be at a minimum since the fields are concentrated above the fin.

XIII. Study of the finned horn

The problem is to pass from a finned guide (single or double) to the free space. The shape of the fins, inside the horn must be such that the cut-off frequency remains below the operating frequency band whilst still maintaining a sufficient match.

For conventional horns, matching is a function of the dimensions of the input waveguide, the aperture as well as the length of the horn. The different parameters of a horn are shown in FIGS. 5*a* to 5*d*.

In practice, to ensure that the front of the cylindrical wave transmitted from the centre $S_H$ (or $S_E$) is considered as being equiphased, it is necessary, as remarked by BUi-Hai in "Antennes micro-ondes—Application aux faixceaux Hertziens" Masson (1978) that $$\sin\,\Theta_o \leqq \lambda/2B \quad \sin\,\phi_o \leqq \lambda/2A \quad (13)$$

choosing the dimensions of the horn: the inter-element spacing between 22.5 mm, a width of 22 mm may be chosen for the aperture. Assuming that one can use the relation (13) for a finned horn, it is easy to demonstrate that the minimum length of the horn (H) is equal to 13.5 mm.

By choosing H to be equal to 20 mm, the relation (13) is then satisfied.

$$H=20 \text{ mm.}$$

radiation diagram: the radiation diagram of a pyramidal horn can theoretically be evaluated with the aid of the publications by Ediss "pyramidal horns at 460 GHz" Electronic Letters, 20, 345 (1984). Unfortunately, the literature does not contain any analytic formulations as regards radiation by a finned horn.

Also in a first approximation, if the fact is taken into account that the aperture of the horn is the sole radiating element, the approximated radiation diagrams can be deduced from the theory relating to rectangular apertures. The relative values of these radiation diagrams in the planes (E) and (H) are given in FIG. 5*c* at the respective curves $D_E$ and $D_H$ for the values A=22 mm and $\lambda$=24.79 mm.

However, the real diagrams may be a bit further removed from these theoretical diagrams because of the fact that the latter will take into account the phase-shift ($\Delta$) on the aperture and, more specifically, the diffraction at the edges of the horn.

gain of the horn: the gain of a pyramidal horn may be calculated as a function of the gains of the sectorial horns having planes (E) and (H).

This gain can be easily evaluated with the aid of the Braun Tables ("Some data for the design of electromagnetic horns" IEEE Transactions AP4, 29, (1956)) and can be written:

$$G=1.9635\cdot 10^{-3}[G_x\cdot G_y][1/(L_E/\lambda)(L_H/\lambda)]^{-\frac{1}{2}} \quad (14)$$

With the dimensions defined in the foregoing for the finned horn and assuming that the relation (14) is valid in this case, it is possible to demonstrate that the theoretic gain, at 12.1 GHz, will be of the order of 8.8 dB.

For a pyramidal horn of the same aperture, but having a size of 15×15 mm at its input, and the same length (20 mm), the desired gain is of the order of 9 dB. Then, assuming that the formulation (14) can be applied to our case, one must expect a decrease in the gain for the finned horn, compared to the pyramidal horn.

adaptation of the horn: the publications by Walton and Sundbey ("Broadband ridged horn design", The microwave journal, 96, (1964)) show that the best possible adaptation of a dual-finned horn is obtained when the impedance of the "finned waveguide", along the horn, varies in accordance with the following laws:

$$\begin{cases} o \leqq x\ s\ H/2 & Z = Z_{o\infty}\cdot expkx \\ H/2 \leqq x\ s\ H & Z = 377\cdot +Z_{o\infty}\{1\cdot -expk(H-x)\} \end{cases} \quad (15)$$

wherein $Z_{o\infty}$: excitation impedance of the waveguide at an infinite frequency $Z_{pv}$ 377: impedance of the vacuum, k: a constant such that the impedance in H/2 is equal to half the sum of the excitation and output impedances.

H: height of the horn.

Actually, when reference is had to the relation (15) giving the impedance $Z_{pv}$ and if it is assumed that b'=b and s=a (which is the case at the output of the horn) it will be found that the output impedance must be equal to:

$$Z_{out}=(2B/A)Z_{vacuum}$$

where $$Z_{vacuum}=377\Omega.$$

Also the relations (15) can only be realized for a ratio (B/A) equal to 0.5. For our case, where the ratio (B/A) is equal to 1, one must then take:

$$Z_{out}=754 \text{ ohms.}$$

XIV. Single-fin antenna

Based on the "optimum" shape, defined in the preceding paragraph of the fin inside the horn, a fin has been defined experimentally such that the adaptation of the horn remains satisfactory whilst yet minimizing the asymmetry effect in the plane (E). A comparison between the theoretical shape $P_3$ of the fin and the experimental shape ($P_4$) is shown in FIG. 6*e*.

XV. Antenna having pseudo-dual fins

A much more interesting solution is to make the radiation diagram symmetrical, so to render the radiation element geometrically symmetrical.

With this object in mind, a change has been realized in the horn from a single fin to a double fin, whilst still keeping the adaptation under control (see FIG. 6*f*).

The profiles $P_5$ and $P_6$ illustrate the pseudo-dual fins and the profile $P_7$ is the theoretical shape of the single-finned horn which behaves in the same way.

The pseudo-dual fin technique has the advantage that it makes the radiation diagram symmetrical in the "E" plane (the diagram of the element remains however somewhat asymmetrical, and decreases the mutual coupling.

Compared to the single-fin antenna, a slight increase in the aperture angle to 3 dB is found. The influence of this increase need not be detrimental to the ultimate antenna: FIG 11*b* shows the profile of the envelope $C_1$ of the plane H radiation diagrams of the C.C.I.R. and also the theoretical envelopes obtained with an antenna comprising, in the plane "H", 32 elements of the single ($C_4$) or pseudo-dual fin ($C_3$) types.

A theoretical simulation shows that in the plane (H), whatever the radiating element used in the location where the geometrical symmetry exists, the radiation diagram is symmetrical and moreover is in agreement with the theory.

In the plane "E", a symmetrical geometrical structure is absolutely necessary to arrive at a perfect symmetry of the radiation diagram, which is the case for the double-fin horn.

XVI. Gain

The different gain measurements of the single or pseudo-double finned radiating element have resulted in gains comprised between 8 and 9 dB.

Knowing the gain of the radiating element, it is then possible to predict the total overall gain of a network antenna comprising N radiating elements, using the following formula:

$$G_{total}\,(\text{dB}) = 10\ \text{Log}_{10}N + G_{elements} - p_{losses\ supply\ circuit} \quad (15)$$

Moreover, it is written in the book by Buihai that when the aperture of the horn has a square cross-section, the use of an excitation waveguide having the same section must be preferred.

Such a variation then renders it possible to increase the gain slightly (see Braun "Some data for the design of electromagnetic horns) IEEE Transactions $AP_4$, 29 (1956)).

XVII. Study of the losses

As has already been described, one must expect losses of the order to decibel/meter for the dimensions opted for. The experimental study of this antenna has demonstrated:

the necessity to have a perfect electrical contact along the whole line, as otherwise the losses will be increased, the necessity to have a line with a low degree of roughness.

The below Table I shows the preferred values of the dimensions of the different elements of the antenna in the embodiment described in the foregoing.

TABLE I

| | |
|---|---|
| Interelement spacing | d = 22.5 mm |
| Horn dimension | A = 22 mm |
| Horn height | H = 20 mm |
| Fin dimensions | s = 2.2 mm |
| | b' = 0.9 mm |
| Waveguide dimensions | a = 8 mm |
| | b = 3.6 mm |
| Number of antenna elements | 32 elements |
| Operating wavelength | $\lambda$ = 24.79 mm |
| Gain of an element | G ≃ 8.8 dB |
| Cut-off frequency | $f_c \simeq$ 10 GHz. |

XVIII. Method of realizing such an antenna

Because of the fact that the waveguide supply network is designed in a plane parallel to the plane of the horn apertures, it is possible to realize the antenna completely in the form of a planar antenna using only two plates. These plates may be metal, machined plates or they may be made of moulded plastic with metal-plated surfaces.

In accordance with a first embodiment illustrated by FIGS. 7*a* and 7*b*, the antenna is formed by two plates 100 and 110 whose main faces 101 and 102 for the plate 100, and the main faces 103, 104 for plate 110 are arranged in parallel with the reference plane. The plate 100 comprises a number of unit modules which is a multiple of four, of four horns positioned adjacently, in such manner that all the horns are derived one from the other by a translation of the same step size along the two parallel directions at the sides of the square apertures. The horns are made such in the thickness direction of the plate 100 that the apertures are flushed with the face 101 and that the throats 4 are flush with the face 102, the thickness of the plate 100 being in a position equal to the height h of the horns (see FIGS. 4*a* and 5*a*). The plate 110 comprises the elbows 2 and the planar supply network for the antenna formed by slots recessed in the face 103 of this plate. The slots have a width a and a depth b and constitute three of the faces of the waveguides of the network. Applying the face 103 of the plate 110 on the face 102 of the plate 100 forms the fourth face of the rectangular cross-section waveguides of the supply network and connect the horns to the network thus formed. It should be noted that the plate 110 must have a thickness which is slightly higher than the quantity b, so that the overall thickness of the planar antenna thus formed is given a value which is slightly higher than the quantity b+h.

In accordance with a second embodiment, illustrated by FIG. 8, the antenna is formed from two plates 200 and 210 whose main faces 201 and 202 as regards plate 200, and the main faces 203 and 204 as regards the plates 210 are in parallel with the reference plane P. The plate 200 comprises the unit modules which are positioned adjacently to each other, as in the above-described embodiment. The horns are formed in the thickness direction of the plate 200 such that the apertures are flush with the face 201 and that the throats are located in the depth of the material forming the plate 200. The latter is given a uniform thickness in the height direction h of the horns increased by the value of the dimension b of the waveguides. The antenna supply network is produced on the face 202 of the plate 200 in the form of recessed slots having a width a and a depth b, and elbows 2 by means of which it is possible to connect the throats of the horns to the slots. The plate 210 is a single strip with parallel faces. Applying the face 203 of the plate 210 on the face 202 of the plate 200 forms the fourth face of the waveguides of the supply network.

The antenna produced in accordance with one of the above-described embodiments is consequently cheap to produce. It can be made in large series. It is of a high mechanical strength and does not require adjustment during mounting. To still further facilitate placing the plates 100 and 110, or 200 and 210 one upon the other, positioning pins or any other system for positioning and fixing known to a person skilled in the art may be provided on these plates. The plates may, for example, be kept together face to face by means of screws.

Since this antenna does not contain any dielectric material, the losses therein are as low as possible and, on the other hand it is extremely resistant to ageing.

Moreover, this antenna is of a small size and has a low weight. It is consequently particularly easy to install and it is not very difficult to support it.

Consequently, such an antenna is extremely suitable for use by the general public for receiving television transmissions via satellites. In such a receiving system the antenna is actually an element which derives its importance from two features: in the first place the receiving quality depends directly on the characteristics of the antenna, and secondly the cost of the antenna and its support and also the cost of mounting and directing it to the satellite define for a very large part the final cost of the receiving system.

What is claimed is:

1. A thin unit module for a high-frequency antenna for rectilinearly-polarized waves, said unit module comprising:

(a) four adjacent horns disposed in a frontal portion of the module, said horns having respective rectangular apertures lying in a first common plane and having respective rectangular throats lying in a second common plane parallel to said first common plane;

(b) an internal power divider network disposed in a portion of the module behind the frontal portion and including a plurality of T-shaped power dividers comprising rectangular waveguide sections each extending longitudinally in a direction parallel to the first and second common planes, said power divider network including:

(1) a first T-shaped power divider comprising a base portion and a cross-bar portion, said base portion having a free end for facilitating coupling of signals into or out of the module, and said cross-bar portion having first and second ends;

(2) a second T-shaped power divider comprising a base portion coextensive with the first end of the cross-bar portion of the first T-shaped power divider and comprising a cross-bar portion having two respective ends for coupling to respective first and second ones of the four adjacent horns;

(3) a third T-shaped power divider comprising a base portion coextensive with the second end of the cross-bar portion of the first T-shaped power divider and comprising a cross-bar portion having two respective ends for coupling to respective third and fourth ones of the four adjacent horns;

(c) four elbow-shaped rectangular waveguide sections, each having a first end coupled to the throat of one of the horns and having a second end coextensive with a respective end of one of the cross-bar portions of the second and third T-shaped power dividers;

the length of each of said horns and waveguide sections being dimensioned to effect equalization of the length of respective signal propagation paths between the horn apertures and the free end of the first T-shaped power divider;

at least one of the waveguide sections including a longitudinally-extending fin disposed on an inner surface of a side of said section.

2. A unit module as in claim 12 where each of the elbow-shaped rectangular waveguide sections includes a longitudinally-extending fin disposed on an inner surface of a side of said section.

3. A unit module as in claim 2 wherein each horn includes a pair of longitudinally-extending fins disposed on opposite side walls of said horn.

4. A unit module as in claim 1 comprising first and second adjacent plates having conductive surfaces, the horns being formed by the first plate, and the waveguide sections being collectively formed by the first and second plates.

5. A high-frequency antenna for rectilinearly-polarized waves, said antenna including a plurality of thin unit modules, each comprising:

(a) four adjacent horns disposed in a frontal portion of the respective module, said horns having respective rectangular apertures lying in a first common plane and having respective rectangular throats lying in a second common plane parallel to said first common plane;

(b) an internal power divider network disposed in a portion of the module behind the frontal portion and including a plurality of T-shaped power dividers comprising rectangular waveguide sections each extending longitudinally in a direction parallel to the first and second common planes, said power divider network including:

(1) a first T-shaped power divider comprising a base portion and a cross-bar portion, said base portion having a free end for facilitating coupling of signals into or out of the module, and said cross-bar portion having first and second ends;

(2) a second T-shaped power divider comprising a base portion coextensive with the first end of the cross-bar portion of the first T-shaped power divider and comprising a cross-bar portion having two respective ends for coupling to respective first and second ones of the four adjacent horns;

(3) a third T-shaped power divider comprising a base portion coextensive with the second end of the cross-bar portion of the first T-shaped power divider and comprising a cross-bar portion having two respective ends for coupling to respective third and fourth ones of the four adjacent horns;

(c) four elbow-shaped rectangular waveguide sections, each having a first end coupled to the throat of one of the horns and having a second end coextensive with a respective end of one of the cross-bar portions of the second and third T-shaped power dividers;

the length of each of said horns and waveguide sections being dimensioned to effect equalization of the length of respective signal propagation paths between the horn apertures and the free end of the first T-shaped power divider;

at least one of the waveguide sections including a longitudinally-extending fin disposed on an inner surface of a side of said section.

6. An antenna as in claim 5 where the unit modules are adjacent to each other and where the respective common planes in the modules are coextensive.

7. An antenna as in claim 6 comprising first and second adjacent plates having conductive surfaces, the horns being formed by the first plate, and the waveguide sections being collectively formed by the first and second plates.

8. An antenna as in claim 7 where the plates comprise conductive material.

9. An antenna as in claim 7 where the plates comprise dielectric material having faces covered with conductive material.

* * * * *